United States Patent [19]

Sloan

[11] Patent Number: 4,487,608

[45] Date of Patent: Dec. 11, 1984

[54] DYEING OF FIBROUS MATERIALS

[75] Inventor: Frederick R. W. Sloan, London, England

[73] Assignee: Lintrend Limited, London, England

[21] Appl. No.: 474,640

[22] PCT Filed: Jul. 1, 1982

[86] PCT No.: PCT/GB82/00193

§ 371 Date: Mar. 1, 1983

§ 102(e) Date: Mar. 1, 1983

[87] PCT Pub. No.: WO83/00172

PCT Pub. Date: Jan. 20, 1983

Related U.S. Application Data

[63] Continuation-in-part of Ser. No. 354,086, Feb. 3, 1982, which is a continuation-in-part of Ser. No. 237,874, Feb. 25, 1981, abandoned.

[30] Foreign Application Priority Data

Jul. 1, 1981 [GB] United Kingdom ..... 8120333

[51] Int. Cl.[3] ..... D06P 1/22; D06P 1/38; D06P 3/66; D06P 5/00

[52] U.S. Cl. ..... 8/493; 8/496; 8/537

[58] Field of Search ..... 8/493, 496, 537

[56] References Cited

U.S. PATENT DOCUMENTS

| | | | |
|---|---|---|---|
| 2,524,113 | 10/1950 | La Piama | 8/115.6 |
| 2,739,908 | 3/1956 | Marsh | 8/115.6 |
| 3,893,804 | 7/1975 | Hepp et al. | 8/496 |
| 3,901,014 | 8/1975 | Hiroi et al. | 8/125 |

FOREIGN PATENT DOCUMENTS

| | | | |
|---|---|---|---|
| 573126 | 11/1958 | Belgium | 8/496 |
| 727888 | 4/1955 | United Kingdom | 8/125 |

OTHER PUBLICATIONS

Kantner, Amer. Dyestuff Reporter 10/31/60.

*Primary Examiner*—Maria Parrish Tungol
*Attorney, Agent, or Firm*—Lawrence Rosen

[57] ABSTRACT

Viscose or other regenerated cellulose fibres are prepared for dyeing by cross-linking the fibres, and they are then dyed by a continuous dyeing technique, followed by fixing of the dye in the fibres. The continuous dyeing generally involves impregnating the assembly in one or more impregnation stages with a vat or reactive dye and alkali. The process results in improved dye receptivity. The process is of particular value for the production of dyed fabrics and yarns and novel products comprise cross-linked regenerated cellulose fibres dyed with vat or reactive dyes. Other disclosed processes involve stretching cross-linked viscose fibres during mercerization, and cross-linking crimped fibres.

15 Claims, No Drawings

DYEING OF FIBROUS MATERIALS

The U.S. Application designated in this application is a continuation-in-part of the U.S. application Ser. No. 354,086 filed by Frederick Richard Wilfred Sloan on Feb. 3, 1982 which is a continuation-in-part of Ser. No. 237,874 filed Feb. 25, 1981 now abandoned and derived from PCT/GB 81/00120 of 1 July 1981, the entire disclosure of which is completly incorporated herein by reference.

There are two main ways of dyeing self-supporting fibre assemblies such as fabric, yarn, tow or sliver, namely batch or continuous. Typical batch methods involve lowering the fibre assembly into a bath of the dye liquor, allowing it to remain in the bath for a predetermined period, sometimes with gentle agitation, and then removing it from the bath. Throughout this process the assembly may be carrying its own weight but will not otherwise be under tension.

In continuous methods the assembly is impregnated continuously with a dye liquor and, if necessary, is subsequently subjected to processes by which the dye is fixed. The continuous impregnation involves continuously drawing the assembly under tension through the or each impregnation stage. For instance the continuous assembly may be drawn through an impregnation bath, e.g. around a padding roll, and the act of drawing the assembly through the bath necessarily subjects the assembly to longitudinal tension. The continuous dyeing process may be carried out in a truly continuous fashion with any fixing or rinsing treatments being carried out continuously and successively on the fabric that is dyed with the dye, or it may be carried out in a semi-continuous process, with a batch of the assembly being continuously dyed, and this batch then being subjected to, for instance, a separate fixing operation.

Fibre assemblies formed of cotton and many other fibres can be dyed by either the described batch dyeing or continuous dyeing. Assemblies containing viscose are, however, more difficult to dye satisfactorily for a number of reasons. Viscose fibres tend to be weakened by the presence of aqueous liquors, especially if they are alkaline, and so in practice it is essential to minimise the tension applied during impregnation with the dye liquor. In practice this means that it is difficult or impossible satisfactorily to dye viscose fibres by continuous dyeing techniques without stretching the fibres.

Another problem that arises in continuous dyeing techniques, especially when the liquor is alkaline, is that the viscose fibres tend to absorb the dye very slowly and so inadequate dyeing occurs during normal padding or other continuous dyeing methods.

The normal way therefore of dyeing a self-supporting assembly of viscose fibres has been by batch dyeing. A typical method is known as winch dyeing and involves lowering a loop of fabric or tow on a winch into a bath of dye liquor, gently agitating the fabric or tow within the liquor, and then raising it out of the liquor and drying it. The dyes are normally substantive dyes and so their colour may not be as fast as desirable.

Vat and reactive dyes are known to have the potential advantage of being very fast, because of the fixing of the dye in or to the fibre, but have to be applied from an alkaline medium. This makes it difficult to obtain good colour intensity in viscose fibres. In practice therefore these dyes have tended not to be used with viscose fibres and, if they are to be used at all, reasonable results require prolonged batch dyeing and the use of large amounts of dye.

Many processes have been developed involving the chemical treatment of cotton fibres with, for instance, textile resins or cellulosic cross-linking agents and it is sometimes mentioned that viscose fibres can be subjected to similar treatments. In practice all such treatments are normally conducted on cotton fibres that have already been dyed.

There have also been a few proposals in the literature aimed specifically at the chemical treatment of viscose. One such proposal is in British patent specification No. 1,034,453 in which Example 2 describes impregnating viscose rayon fibre tow with a cross-linking agent, curing this, spinning and weaving the fibres, and then mercerising the fabric. The fabric is then "dyed in the normal fashion". As explained above, the normal fashion would have involved batch dyeing with a substantive dye.

In practice however there has been no successful chemical treatment of viscose fibres to give them good physical properties such as crease resistance and dirt repellancy and softness.

The result of all this is that viscose fibres have in practice been regarded as suitable only for making cheap fabrics such as linings (the colour and physical properties of which are relatively unimportant) or for blending with cotton or other higher quality fibres (reliance being placed upon the higher quality fibres to conceal the poor dyeability and other physical properties of the viscose).

In European Patent Publication No. 0044172 (published Jan. 20th, 1982) a process is described for producing a fabric containing viscose fibres and that is characterised in that the fibres have been cross-linked and the fabric becomes softer with increasing humidity.

We have now found that cross-linking of regenerated cellulose fibres has remarkable, and hitherto unreported, effects on the dyeability of the fibres. These remarkable effects are not observed, and do not occur, during the conventional batch dyeing using substantive dyes.

In the invention a continuous, self-supporting, fibre assembly comprising regenerated cellulose fibres is dyed by a process that is characterised in that the fibres are cross-linked before dyeing and the dyeing is effected by continuously dyeing the assembly with a dye and then fixing the dye in the fibres. It will be appreciated that the dye that is continuously dyed into the assembly may be the dye that is finally fixed or may be a precursor that may be chemically changed during the fixing process into the final dye. For instance the fibres may be impregnated with a precursor that is a reduced form of the dye and fixing may then be achieved by oxidising the precursor to the final dye.

The cross-linking results in the viscose fibres having improved dye receptivity compared to uncross-linked fibres with the result that they can absorb sufficient amounts of dye much more quickly than previously, especially when the dye is applied from an alkaline liquor. The cross-linking also improves the physical properties of the fibres with the result that the assembly can more readily withstand the tension to which it is necessarily subjected during continuous dyeing.

The dyes that are now most widely used for continuous dyeing of textiles are vat and reactive dyes and these dyes are preferred for use in the invention. As is well known, their use involves impregnating the fibres with at least one alkaline liquor and it is also very well known that normal viscose fibres are weakened or even dissolved in alkali and absorb dye from alkali very slowly. It is therefore very surprising that in the invention the fibres withstand undesirable stretching (despite the tension inevitably applied during continuous impregnation) or other physical damage due to alkali and have enhanced dyeability.

The continuous dyeing step of the invention is preferably effected by impregnating the continuous assembly in one or more impregnation stages with an aqueous liquor containing a vat or reactive dye and with an aqueous alkaline liquor and fixing the dye, continuously drawing the assembly under tension from the or each impregnation stage, and washing the assembly.

In one method the assembly is impregnated with alkaline liquor containing reactive dye or vat dye and the dye is then fixed and the assembly washed. In another method the assembly is impregnated with a non-alkaline liquor containing vat dye or reactive dye and is impregnated in a separate (usually subsequent) stage with an aqueous alkaline solution, the dye is fixed (by the alkaline impregnation or by a separate step) and the assembly washed. The one or more impregnation stages may be carried out by conventional continuous techniques, for instance drawing the continuous assembly around a padding roll or through a padding mangle and drawing it away from the liquor.

The process may be a truly continuous process with the fixing and washing being carried out continuously with the impregnation. For instance the continuous assembly may be continuously passed through one or more impregnation stages and may then pass directly and continuously through a fixing stage and directly and continuously through a washing stage.

The overall process may, however, be a semicontinuous process with at least one part being carried out as a batch process separate from the other part or parts. For instance a first batch process may comprise continuous dyeing of a length of the assembly and a second batch may then comprise chemically fixing the previously dyed length. For instance the length may be continuously dyed and may be then wound into a roll which may be left for several hours to permit fixing to occur.

When the dye is a vat dye the alkali should provide a pH of 10.5 to 13, generally about 11.5 to 12.5. The dye may be impregnated from an alkaline solution having such a pH and containing reduced, solubilised vat dye that may have been produced in situ by alkaline reduction of oxidised vat dye, e.g. using sodium hydrosulphite and sodium hydroxide. Alternatively the vat dye may have been supplied to the user in a solubilised, leuco, form and it may then be preferred to impregnate it from a neutral or acidic solution.

If the assembly is tightly woven or if very dark shades are required better results may be obtainable by conducting the impregnation in two stages. In the first stage the assembly is impregnated with a dispersion of the oxidised vat dye, for instance by the technique known as pigment padding. In the second stage the assembly is impregnated with an alkaline solution of a reducing agent, for instance a solution of sodium hydroxide and sodium hydrosulphite. This solubilises the dye in the fibre assembly. Typically these two stages are carried out in two separate batches, each batch involving continuous impregnation. For instance after a length of fabric has been pigment padded it may be transferred to a jigger in which it is passed back and forth through a bath of the alkaline reducing solution.

Chemical fixing of the vat dye is then brought about by oxidation, either continuously with the impregnation step or steps or as a separate batch process. Oxidation preferably is by continuous impregnation with alkaline oxidising agent such as sodium nitrite or nitrate or perborate. Dyeing and fixing is normally conducted at 20 to 50° C., normally ambient temperatures.

Suitable vat dyes include those sold by ICI plc under the trade names "Caledon" (preferably for pigment padding) and "Soledon" (preferably for impregnation from acid solution).

When the dye is a reactive dye the pH of the alkali can be lower, typically 8 to 11 preferably 8.5 to 10. Generally the alkali is provided by sodium bicarbonate but sodium hydroxide can be used. The alkali can be applied separately from the dye (generally after the dye) but preferably the dye is impregnated continuously into the assembly from the esired alkaline liquor. Fixing may be achieved in known manner by storing the impregnated assembly for a few hours, (e.g. 1 to 12 hours, preferably 3 to 8 hours and most preferably overnight) or by heating to a relatively high temperature for a short period of a few seconds or minutes. When fixing is by storage the overall process is preferably a semi-continuous process with a length being dyed and then this length being stored, for instance on a revolving roller, during fixing. When fixing is by heating the process conveniently is a truly continuous process with the assembly being drawn continuously from the padding or other impregnation system directly through the heating stage. Temperature during dyeing and storage is typically 20 to 70° C. while the temperature for heat fixation is preferably 100 to 150° C.

Suitable reactive dye include those sold by ICI plc under the trade name "Procion".

After fixing the assembly is then washed, for instance by soaping and with water in the normal way. This may be carried out continuously with the fixing or as a separate batch operation. The assembly is then dried.

The regenerated cellulose fibres may be conventional viscose fibres or they may be other regenerated cellulose fibres, for instance crystalline rayon such as the high wet modulus products known as Modal.

The assembly includes a substantial proportion of viscose or other regenerated cellulose fibres, generally at least 30% by weight. More usually the amount is above 50% and it may be 100%. All percentages are by weight unless otherwise specified. If the assembly includes other fibres they may be synthetic or natural. Suitable blended products contain from 50 to 90% viscose or Modal and 10 to 40% cotton, linen or polyester.

When the final product is a blend the entire blend may have been subjected to cross-linking or if desired the viscose fibres may be cross-linked and then blended with the other fibres.

Fabrics containing a blend may be formed of yarns consisting of viscose and yarns consisting of other fibres but more usually are formed of yarns each comprising a blend of viscose and the other fibres. Suitable methods of forming appropriate blends are known and reference may be made to, for instance, PCT Publication WO80/00463.

The fibre assembly must be a continuous, selfsupporting assembly before dyeing and thus may be a tow or sliver but more usually is a yarn or fabric. The process is of particular value for the production of dyed yarn, either by dyeing yarn or by spinning yarn from dyed tow or sliver.

The fibres may be in the same form of fibre assembly during the continuous dyeing stage as they were during the cross-linking stage, or they may be cross-linked in the form of some other assembly and then converted to the continuous assembly that is to be dyed.

In one process the fibres are in fabric form before cross-linking and so are cross-linked and dyed while in the form of a fabric. In another process the fibres are in the form of a tow, sliver or yarn during the cross-linking and are dyed either in that form or in some other form. For instance a tow or sliver may be converted to a yarn or fabric or a yarn may be converted to a fabric, before dyeing. Particularly preferred processes are those in which the cross-linking is conducted on a tow, that is to say an assembly of continuous fibres, or a sliver, that is to say an assembly of staple fibres, especially when the staple or continuous fibres are crimped. The cross-linking of such products, and especially products containing crimped fibres, facilitates the production of knitting yarns having very good loop strength.

The cross-linking is effected by impregnating the chosen fibre assembly with a cross-linking agent and an activator for the cross-linking agent and curing the cross-linking agent. The curing is generally conducted while the fibres are in the same type of assembly as during impregnation but if the fibres were, for instance, in the form of a tow or sliver during impregnation with the cross-linking agent they may be converted into a yarn or fabric before curing. The impregnation with the cross-linking agent is generally conducted in a continuous manner, e.g. on a padding mangle or padding roll.

The cross-linking agent may be any material capable of cross-linking the cellulosic molecules. Formaldehyde donors are therefore suitable but preferably a conventional cellulosic cross-linking agent is used. This is a bi- or poly-functional reagent that will react with, and thus bridge and cross-link, hydroxy groups in the cellulose.

Typical bi- or poly-functional compounds that serve as cross-linking agents are alcohols, triazones, aldehydes such as glyoxal, and methylol urea derivatives that will react with cellulose in preference to undergoing self polymerisation, such as dimethylol cyclic methylene or ethylene or other alkylene urea.

Activators suitable for use with such cross-linking agents are well known and are generally referred to as catalysts or curing agents. They generally are acidic, for instance inorganic or organic acids such as citric or succinic acid or acidic salts such as magnesium chloride. Preferably, instead of using phase separation catalysts such as these, non-phase separation curing agents (for instance a triethylene glycol citric acid or other citric acid water soluble polyester) are used since they improve dyeability still further.

The cross-linking agent and activator are generally applied from an aqueous solution containing, for instance 5 to 30% of the cross-linking agent and 0.5 to 5% of the activator. The pick up may be, for example, 20 to 80% by weight of the solution.

Curing of the cross-linking system may be achieved by, for instance, heating at 120 to 220° C. for 5 to 0.5 minutes.

The preferred cross-linking agents are cyclic alkylene urea derivatives, for instance dihydroxy dimethylol cyclic methylene or ethylene urea and it is convenient to express the degree of cross-linking by reference to the add-on of such cross-linking agents to the fabric. In general the degree of cross-linking should be below 15 or 20% add-on since larger amounts do not increase the dye receptivity and may have adverse effects on the other properties of the product. Generally the degree of cross-linking should be above 0.2 or 0.5% and preferably above 1 or 2%, add-on, since lower amounts tends to give inadequate improvement in dye receptivity. The optimum add-on depends both on the desired effect on dyeability and on other physical properties. When the dyeing is being conducted on tow, sliver or yarn it is generally preferred that the add-on should not be more than about 8% and typically is from 1 to 5%. This not only proves sufficient for improved dyeability but also permits the production of a knitting yarn having good loop strength. When the dyeing is being conducted on a fabric higher levels of add-on may be preferred, typically 5 to 10%.

When a different type of cross-linking agent is used then different, but equivalent, amounts of add-on will be required. For instance if the cross-linking agent is formaldehyde, either introduced as such or liberated from a formaldehyde donor, then the equivalent amounts of add-on will be very much less, due to the lower molecular weight of formaldehyde.

Useful products, such as dyed upholstery fabrics, can be made from a fibre assembly that has merely been cross-linked and dyed in the described manner but preferably the fibres are mercerised after cross-linking, and generally before dyeing. The mercerisation can improve the physical properties of the fibres, such as softness and wet and/or dry crease resistance and may also improve dyeability. The combination of cross-linking and mercerisation gives a particular improvement in dye receptivity and it is easily possible to obtain a 50% increase in colour yield.

The mercerisation may be conducted on the fibres while they are in the same type of fibre assembly as during cross-linking, or they may be converted to a different form of continuous assembly after cross-linking and before mercerisation. In one preferred process the fibres are mercerised while in the form of a tow or sliver or yarn, this being particularly desirable when the process is being conducted to produce a dyed tow, sliver or yarn.

The mercerisation will result in swelling of the fibres and it is often preferred that the conditions are such that some at least of the fibres remain permanently shrunk by at least 5%. This measurement is along the axis of the fibre. If the fibre is uncrimped the shrinkage is therefore recorded by the reduction in length of the fibres. If the fibre is crimped the shrinkage may be manifested by a tightening of the crimp but little or no reduction in overall length. However there is often at least 5% shrinkage in overall length since the actual shrinkage is preferably at least 10%, generally 10 to 25% and most preferably 15 to 20%.

For any particular degree of cross-linking there will be a potential shrinkage obtainable in the assembly during prolonged mercerisation and preferably the conditions of mercerisation are such that at least 25% of the potential shrinkage is attained in all fibres and preferably at least some of the fibres shrink by at least 50% and preferably at least 75% of their potential shrinkage.

When the assembly that is being mercerised is a fabric, the described shrinkages are preferably obtained in the weft direction. It has surprisingly been found that application of tension during mercerisation gives a valuable improvement in strength and other physical properties and so it is often preferred to apply tension in the length direction to yarn, tow or sliver (and sometimes to fabric) during mercerisation. This increase in strength may be obtained even at very low degrees of cross-linking, e.g. 0.1 to 1% add on.

The mercerising conditions will be affected by the extent of cross-linking since a typical mercerising liquor will give optimum mercerisation of a product having low cross-linking, e.g. up to 5%, in a short time (typically 5 to 10 minutes) but more highly cross-linked products may need a longer time, e.g. 15 to 60 minutes.

Known mercerising reagents and temperatures may be used for the mercerising step in the invention. Suitable reagents are strong ammonia, cuprammonium solutions and other alkaline solutions generally of alkaline earth metal hydroxides, for instance calcium hydroxide or alkali metal hydroxides, generally sodium hydroxide, the latter being preferred. Typical concentrations of caustic soda or other reagent are 10 to 40%, especially 20 to 30%, by weight giving about 60° Tw. Treatment preferably comprises impregnation e.g. by immersion in a 3 bowl trough mangle at a temperature below 30° C., preferably 0 to 10° C. Impregnation of caustic soda between 0°–10° C. is the preferred method. This is obtained by refrigerating the caustic soda and circulating the liquor in the trough for the impregnating mangle. The contact with alkali is generally relatively quick, for instance ½ to 30 minutes and usually 1 to 10 minutes, whereupon the fibre assembly is washed with water to eliminate the alkali or other mercerising reagent.

A fabric consisting or containing a large proportion of viscose fibres will generally have a wet crease angle of about 90°, and this angle is not substantially changed by the cross-linking. However the wet crease angle after the mercerisation and permanent shrinkage in the invention can easily be increased to 120° or more, for instance as much as 140°. Accordingly mercerised and shrunk fabrics of the invention have good wet crease resistance.

The dry crease resistance of untreated viscose fabric is generally around 100° and this may be increased slightly, for instance to 110°, by the cross-linking. However the mercerisation will generally result in a reduction of this, for instance back to a value of about 100°. The loss in dry crease angle is generally less with phase separation catalysts than with non-phase separation curing agents as discussed above.

The crease angles mentioned herein are the angles measured by the Shirley Crease Angle test. Higher values indicate better properties.

Although products obtainable by cross-linking and mercerisation as described above have good handle and wet crease resistance, and are thus suitable for use as, for instance, table cloths or upholstery fabrics, it is desirable to improve their dry crease resistance and it has surprisingly been found that this can be achieved without damaging the other properties of the product by applying a textile resin or by further cross-linking the mercerised product, generally after dyeing. This further treatment may be conducted on the same fibre assembly as was dyed or, if that assembly was a sliver, tow or yarn it may be conducted on a different type of assembly, such as a yarn or fabric.

Suitable textile resins are known for the treatment of cotton and may be applied in a similar manner to obtain an add-on of 2 to 10%, preferably 3 to 7% and most preferably around 5%.

Preferably however the dry crease resistance is improved by subjecting the product to a final cross-linking. The solids add-on (measured as described above) is preferably about 2 to 10%, e.g. 3 to 7% most preferably around 5%. The cross-linking materials and process may be selected from the process and materials discussed above for use in the initial stage. Typically the final dry crease angle will be 110 to 140°. Best results are generally obtained using a non-phase separation curing agent, for instance a polyester as mentioned above, and this has the particular advantage that it gives a fabric having better abrasion resistance.

By the invention it is possible both to obtain dyed products having good colour yields using much lower amounts of dye than have previously been required for regenerated cellulose and to obtain fabrics, and yarns by which fabrics can be made, that have a soft handle and good wet crease resistance, and optionally also good dry crease resistance. A particular advantage of the described processes is that it is possible to obtain fabrics that have the unique property of becoming softer with increasing humidity.

The following are examples of the invention.

EXAMPLE 1

A fabric may be formed of yarn formed of a blend of viscose and 25% linen or cotton fibres. The fabric may be impregnated while held on a stenter with 20% w/v solution of dihydroxy dimethylol cyclic ethylene urea activated with 2% w/v triethylene glycol citric acid polyester. The acid value of the polyester may be about 190 and the pH of the impregnating solution should be at least 3.2. The wet pick up of the fabric may be about 70% and the dry add-on about 10% by weight. The fabric may then be dried on the stenter, heated to a temperature of about 170° C. for 2 minutes, washed and dried.

The fabric may then be passed into a bath of caustic soda solution of about 30% w/w concentration and may be drawn out of the bath and partially pulled back to width on a stenter while being rinsed with water. The duration of mercerisation (between contacting the viscose fibres with the caustic soda and rinsing them with water) may be 1 to 2 minutes. The applied lengthwise tension during mercerisation may be such that there is some extension in length, but no tension is applied in the weft direction, with the result that the weft fibres shrink, and the weft dimension reduces, by about 25%. During the rinsing weft tension is applied on the stenter to an amount such that the final shrinkage is about 20%, based on the original width of the fabric. The fabric is rinsed and dried and has very high wet crease resistance.

A dispersion is formed in water of an insoluble "Caledon" vat dye of the chosen colour. A batch length of the fabric is drawn continuously through the dispersion on a conventional pigment padding apparatus, and as a result becomes impregnated in the dispersion.

The batch length may then be transferred to a jigger comprising a bath of impregnating liquor and two rolls by which the length is passed back and forth through the bath. The bath initially may be filled with with an alkaline reducing solution of sodium hydroxide and sodium hydrosulphite, and continuous passage of the impregnated fabric through this bath results in the dye becoming converted to its reduced form and solubilised. When the desired density has been achieved the reducing solution may be replaced with an alkaline solution of sodium perborate as oxidising agent. The fabric may then be passed continuously through this solution so as to insolubilise the dye and fix it in the fabric.

The fabric may subsequently be removed from the jigger and soaped and washed in conventional manner.

EXAMPLE 2

The method of Example 1 is very suitable for the production of dark shades. For lighter shades the method may be modified by impregnating the cross-linked fabric initially with a solution of a vat dye. In particular the dried, cross-linked, undyed fabric prepared in the first part of Example 1 may be impregnated with an acidic solution of a reduced "Soledon" vat dye of the chosen colour. The fabric may then be treated on the jigger with an alkaline liquor of sodium nitrate solution to fix the dye and may then be soaped and washed.

EXAMPLE 3

The process of example 1 may be repeated except that, after dyeing, the fabric may be reimpregnated with a cross-linking solution having the same chemical constituents as the initial solution used in example 1 but only about half the concentration of cross-linking agent and activator. This results in a further add-on of about 5%. The fabric may be dried, heated, washed and dried again, as in example 1. The product has improved dry angle compared to the product of example 1.

EXAMPLE 4

A tow of crimped viscose filaments may be drawn through a bath of the same cross-linking solution as is used in example 1 to give about 4% dry add-on. The tow may be heated to about 170° C. for 2 minutes in order to cure the cross-linking agent. It may then be washed.

The tow may then be immersed in a bath of caustic soda solution of about 30% for about 3 minutes and may be drawn out of the solution under minimum tension, washed and dried.

A batch length of the tow may then be continuously padded on conventionaal padding apparatus through a solution containing sodium bicarbonate and a Procion reactive dye of the desired colour. The length of tow may be wound onto a roll which is slowly revolved for 3 to 6 hours at ambient temperatures, during which fixing of the dye into the fibres occurs. The tow may then be drawn off this roll, soaped and washed in conventional manner. It may be then converted into yarn in conventional manner.

EXAMPLE 5

A yarn of 100% viscose fibres may be wound on a package and impregnated with a liquor containing 100 g/l cross-linking agent and 20 g/l polyester catalyst (preferably the materials used in Example 1). It may then be dried and cured in an autoclave for 2 minutes at 160° C. It may then be wound into hank form, mercerised under tension (preferably under the same conditions as in example 4), washed free from alkali and dried.

The yarn may then be continuously padded through a solution of sodium bicarbonate and "Procion" reactive dye in one or more impregnation stages, and may be passed directly through a heating stage at which it is heated for 2 minutes to about 120° C. to fix the dye and may be passed directly and continuously through soaping and washing stages.

The yarn may then be further cross-linked, by impregnation with the same cross-linking agent and catalyst as in the first cross-linking, but to give a dry add-on of about 2% by weight. It may be then dried, heated, washed and dried.

In an alternative process the cross-linked and mercerised yarn may be woven into a fabric before dyeing and the fabric may then be dyed in the same manner as described for the yarn.

In another alternative process the cross-linked and mercerised yarn may be dyed as in Example 1 or Example 2 with a vat dye, instead of with a reactive dye.

All the exemplified methods give very desirable shades much more quickly and using only about 50% of the amount of dye that is required when the equivalent product is dyed in the same apparatus but without having been cross-linked.

The invention includes not only the described processes but also fibrous products (especially yarns and fabrics) that comprise cross-linked regenerated cellulose fibres dyed with a vat or reactive dye and fabrics, or yarns from which such fabrics can be made, containing cross-linked regenerated cellulose fibres that are dyed with vat or reactive dyes and that become softer with increasing humidity.

The invention also includes, as a separate aspect, a process in which a continuous assembly of cross-linked viscose fibres are mercerised while applying tension in the length direction, the assembly being sliver, tow or, preferably, yarn, or in some instances being fabric. The fibres may be dyed previously or subsequently by a conventional batch or other technique or may be dyed by the continuous dyeing methods described herein.

The invention also includes, as a separate aspect, a process in which a tow or sliver of crimped viscose fibres is cross-linked with an add-on of 0.1 to 5%. The tow or sliver, or yarn formed from it, may then be mercerised and may be dyed previously or subsequently by conventional batch or other technique or by the continuous dyeing methods described herein.

In both of these processes, it is preferred to cross-link the fibres, mercerise them and subsequently further cross-link them-or treat them with textile resins, e.g. as described above in connection with the cross-linking or resin treatment after dyeing.

I claim:

1. A process of dyeing a continuous, self-supporting fibre assembly comprising regenerated cellulose fibres which comprises the steps of (a) cross-linking the fibers by impregnating the assembly with a polyhydroxy cross-linking agent and an activator, curing the cross-linking agent;

(b) mercerising the fibers;

(c) continuously dyeing the mercerised fibers by impregnating the assembly in one more impregnation stage with an aqueous liquor containing a vat or reactive dye and with an aqueous alkaline liquor, continuously drawing said assembly under tension from the or each impregnation stage; and (d) fixing the dye and then washing the assembly.

2. A process according to claim 1 wherein the cross-linking is effected by impregnation of the assembly with a cross-linking agent and an acidic, non-phase separating, activator.

3. A process according to claim 1 in which the activator is a water soluble polyester formed from citric acid and a glycol.

4. A process according to claim 1 wherein the assembly that is impregnated with cross-linking agent is a tow of continuous filaments, a sliver of staple fibres, or yarn.

5. A process according to claim 4 wherein the continuous dyeing is conducted on the fibres while in the form of the tow or sliver or in the form of a yarn or fabric formed from the sliver.

6. A process according to claim 4 wherein the assembly is impregnated with cross-linking agent is a tow or sliver of crimped fibres.

7. A process according to claim 1 wherein the add-on of cross-linking agent is 0.2 to 5%.

8. A process according to claim 1 wherein the assembly is mercerised under lengthwise tension after the cross-linking.

9. A process according to claim 1 wherein the continuous dyeing is effected by impregnating the assembly with aqueous alkaline liquor containing vat dye or reactive dye.

10. A process according to claim 1 wherein the continuous dyeing is effected by impregnating the assembly with a non-alkaline liquor containing vat dye or reactive dye and then with an alkaline liquor and fixing the dye by the alkaline impregnation or by a subsequent step.

11. A process according to claim 1 wherein the fixing and washing are carried out continuously with the impregnation.

12. A process according to claim 1 wherein the impregnation is carried out continuously on a length of the assembly and the impregnated length is then fixed.

13. A process according to claim 1 at least 50% by weight of the fibres in the fibre assembly are viscose or high wet modulus rayon.

14. A process of dyeing a continuous, self-supporting fibre assembly comprising regenerated cellulose fibers in the form of a tow of filaments, a sliver of staple fibers or yarn which comprises the steps of:

(a) cross-linking the tow, sliver or yarn by impregnation with a polyhydroxy cross-linking agent and an activator, curing the cross-linking agent;
(b) mercerising the cross-linked tow, sliver or yarn;
(c) dyeing the mercerised cross-linked tow, sliver yarn by impregnating them in one or more impregnation stages with an aqueous liquor containing a vat or reactive dye and with an aqueous alkaline liquor, drawing said tow, sliver or yarn under tension from the or each impregnation stages;
(d) fixing the dye and then washing the thus treated tow, sliver or yarn; and
(e) knitting said yarn or yarn obtained from said tow or sliver.

15. A process of dyeing a continuous, self-supporting fibre assembly which is a tow, sliver, yarn or woven fabric of regenerated cellulose fibres which comprises the following steps:

(a) cross-linking said fibre assembly by impregnation with a polyhydroxy cross-linking agent and an activator, curing the cross-linking agent;
(b) mercerising the cross-linked fibre assembly;
(c) continuously dyeing the mercerised, cross-linked fibres by impregnating the assembly in one or more impregnation stages with an aqueous liquor containing a vat or reactive dye and with an aqueous alkaline liquor, continuously drawing said assembly under tension from or each impregnation stage;
(d) impregnating the dye fibre assembly with a polyhydroxy cross-linking agent or textile resin and an activator to cross-link the fibre assembly again; and
(e) fixing the dye and washing the resultant fibre assembly.

* * * * *